US007654592B2

(12) United States Patent
Stenzel

(10) Patent No.: US 7,654,592 B2
(45) Date of Patent: Feb. 2, 2010

(54) WHEELED SNOW SHOVEL HAVING VERTICAL LIFT AND PROJECTED FORWARD AND/OR SIDE DUMP

(76) Inventor: Kent J. Stenzel, 4070 Mohawk Dr., Larkspur, CO (US) 80118

( * ) Notice: Subject to any disclaimer, the term of this patent is extended or adjusted under 35 U.S.C. 154(b) by 174 days.

(21) Appl. No.: 11/977,062

(22) Filed: Oct. 24, 2007

(65) Prior Publication Data

US 2009/0108602 A1 Apr. 30, 2009

(51) Int. Cl.
*E01H 5/02* (2006.01)

(52) U.S. Cl. ..... 294/54.5; 294/57; 37/265

(58) Field of Classification Search ..... 294/53.5, 294/54.5, 57; 37/265, 285; 254/131.5
See application file for complete search history.

(56) References Cited

U.S. PATENT DOCUMENTS 3,107,446 A * 10/1963 Messinger ..... 37/434
3,310,891 A * 3/1967 Sachaczenski ..... 294/54.5
3,469,326 A * 9/1969 Malickson ..... 37/265
4,302,894 A * 12/1981 Emma ..... 37/434
5,048,206 A * 9/1991 Jones ..... 37/265
6,663,085 B1 * 12/2003 Dalon ..... 254/131.5
2006/0214443 A1 * 9/2006 Dixon ..... 294/54.5
2007/0113430 A1 * 5/2007 Chang ..... 37/265

* cited by examiner

*Primary Examiner*—Dean J Kramer
(74) *Attorney, Agent, or Firm*—G. F. Gallinger

(57) ABSTRACT a) A frame having a handle, an upright post extending therefrom having a slide stop on an upper portion, a lower and upper slide on a central portion, a lever having a central portion hinged to the frame having a rearwardly extending end, and a forwardly extending slide lift end, attached and configured through a slide lift to lift the lower slide when the rearwardly extending end is depressed; b) a shovel having a bottom snow carrying portion and an upright back portion; c) a lower shovel arm having one end hinged to a lower portion of the upright back portion of the shovel, and the other opposite end hingably connected to the upper slide; d) an upper shovel portion projecting/dumping linkage, having an upper shovel arm having one end hinged to an upper portion of the upright back portion of the shovel and having the other end hingably connected to an upper end of a pivoting arm, the other end hingably connected to the lower slide and a central portion pivotably pinned to a central portion of the lower shovel arm. When the slides are lifted by the lever the shovel is first lifted up the post, and then when the top slide is prevented from further sliding, the bottom slide continues to move, causing the other ends of the lower arm and the pivoting arm to move together, thereby causing the shovel to extend outwardly and turn from a snow collection to a dumping position.

17 Claims, 3 Drawing Sheets

WHEELED SNOW SHOVEL HAVING VERTICAL LIFT AND PROJECTED FORWARD AND/OR SIDE DUMP

FIELD OF THE INVENTION

This invention relates to snow shovels carried on a wheeled frame. More particularly this invention relates to a frame carried, foot powered mechanism which first vertically lifts the shovel to an elevated position, and then extends the shovel forward, or to a selected side, before dumping snow therein from the elevated position.

BACKGROUND OF THE INVENTION

U.S. Pat. No. 4,858,348 issued to J. Lundy in August, 1989 discloses a wheeled frame carrying a snow scoop which comprises a handle to elevate one lateral side of the scoop, after the scoop is filled, to thereby dump snow therein. One problem with this arrangement is that the snow is not thrown to the side. It merely is slid to the side. It may have difficulty sliding out. The snow which is dropped adjacent to one side of the bucket generally falls under as well as beside the scoop. Another problem with this arrangement is that the snow which is dumped from the scoop is not generally lifted above the top portion of the scoop. The dumped snow is likely to fall in front of the wheeled frame as well as falling to the side thereof. If snow on-the-ground is deeper than the scoop the snow in the scoop is thereby prevented from sliding laterally out of the scoop. Yet another problem with this mechanism is that it is only able to dump to a single side. Without the capability to forwardly dump it is difficult to clear a large wide area such as a driveway.

U.S. Pat. No. 6,922,920, issued to A. Stratz in August of 2005, discloses a snow removal device. This device generally lifts vertically; and, once lifted the entire apparatus can be turned to dump to the side, as well as pushed forwardly, before the shovel portion is released dumping the snow. The problem with this device is that operation is more difficult. After the shovel is filled with snow the apparatus must be backed up before it can be turned. When it is turned there may be no snow-cleared area for the operator to walk in behind the shovel. And after the snow is lifted, the apparatus must be balanced before the snow is dumped in order to project or throw the snow forward.

US Patent Application Publication No. 2007/0113430 discloses a wheeled shovel invented by W. G. Chang which lifts, projects, and dumps snow. One problem with the mechanism disclosed therein is that when the shovel begins lifting, it begins dumping. It is not possible to dump to the side. It is not even possible to fully lift the shovel and then turn the wheeled frame. Snow is dumped before it is fully lifted.

Ideally, what is needed, is an snow removal apparatus which is simpler to operate, and which not only projects or throws snow forward, but which additionally lifts the snow-filled shovel portion up and above the snow on the ground before automatically swinging to the side and thereafter automatically dumping the snow. Additionally the snow removal apparatus should alternatively project and dump collected snow to the front, when clearing a patio or driveway, as well as lifting and alternatively dumping snow to the side, when clearing a narrower walkway.

OBJECTS OF THE INVENTION

It is an object of this invention to disclose a snow shoveling apparatus which firsts lifts a snow filled shovel above snow lying on the ground, and then projects or throws that snow out of the way of the shoveling apparatus before automatically dumping. It is an object of this invention to disclose a snow shoveling apparatus which can project and dump snow either forwardly or to a selected side, so that one can best shovel a narrow sidewalk, as well as a relatively wide area such as a driveway. It is yet a further object of this invention to disclose a snow shoveling apparatus which is relatively simple to operate. A shovel which has foot powered lifting and which requires neither balancing, nor turning of the entire apparatus prior to dumping snow.

One aspect of this invention provides for a snow shovel apparatus comprising: a) a frame having; i) an upwardly and rearwardly extending handle; ii) an upright post extending from a front portion of the frame, said post having a lower end portion carried by the frame, an upper end portion having a slide stop, and a central portion having a lower slide, and an upper slide; and, iii) a lever having a central portion hinged to the frame, a rearwardly extending end portion, and a forwardly extending slide lift end portion, attached and configured through a slide lift connection means to lift the lower slide when the foot end portion thereof is depressed; b) a shovel portion having a bottom snow carrying portion and an upright back portion; c) a lower shovel arm having one end portion hinged to a lower portion of the upright back portion of the shovel portion, and having the other opposite end portion hingeably connected to the upper slide; d) an upper shovel portion projecting/dumping linkage, having an upper shovel arm having one end hinged to an upper portion of the upright back portion of the shovel portion and having the other end hingeably connected to an upper end portion of a pivoting arm, said pivoting arm having the other end portion hingeably connected to the lower slide and a central portion pivotably pinned to a central portion of the lower shovel arm. When the slides are lifted by the lift end portion of the lever the shovel portion is first lifted up the post, and then when the top slide is prevented by the top stop from further upward sliding therealong, the bottom slide continues to move upwardly therealong, causing the other ends of the lower arm and the pivoting arm to move together while generally maintained in vertical alignment, thereby causing the shovel portion to extend outwardly and turn from a snow collection to a dumping position.

In a preferred aspect of this invention the frame is wheeled and the lever comprises a foot lever which is configured to have a mechanical advantage so that a substantially greater weight of snow than the force applied to the foot lever can be lifted.

In another preferred aspect of this invention the above shovel apparatus further comprises a shovel turn mechanism so that after the shovel is vertically lifted out of snow, it turns to a side before dumping thereby providing a cleared area in front of the apparatus so that the apparatus can forwardly proceed clearing snow unimpeded by dumped snow; said turn mechanism comprising the upright post configured as a cam and having one of the slides configured as a cam follower.

Various other objects, advantages and features of this invention will become apparent to those skilled in the art from the following description in conjunction with the accompanying drawings.

FIGURES OF THE INVENTION

FIG. 1 is an elevational view of the snow shovel apparatus. FIG. 1A shows the shovel portion on the ground. FIG. 1B shows the shovel portion vertically lifted as the foot lever is initially depressed. FIG. 1C shows the shovel portion extended and dumping when the foot lever is fully depressed.

Figure 1C:
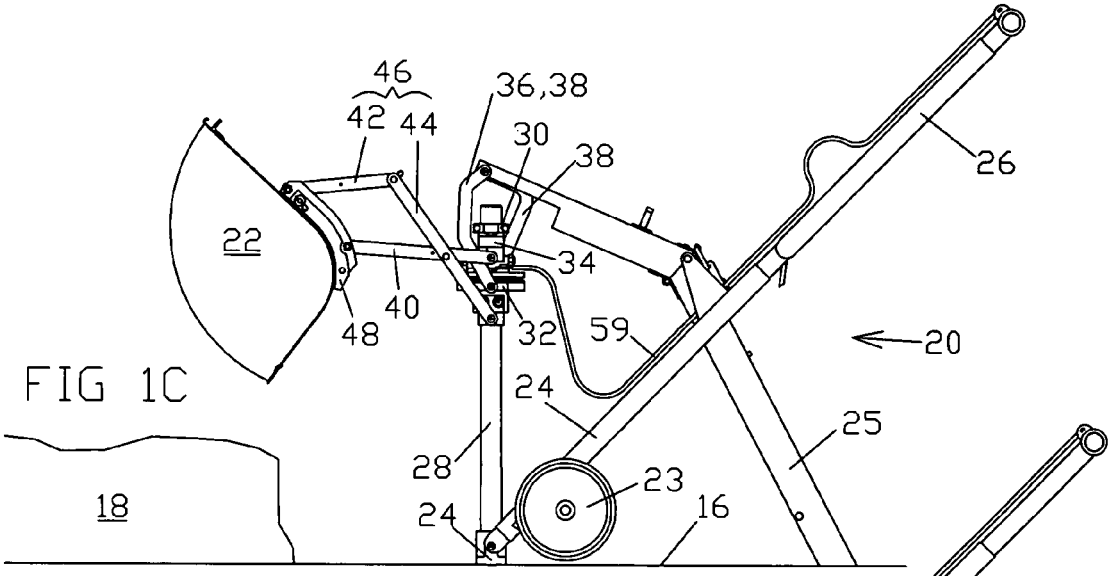

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 1B:
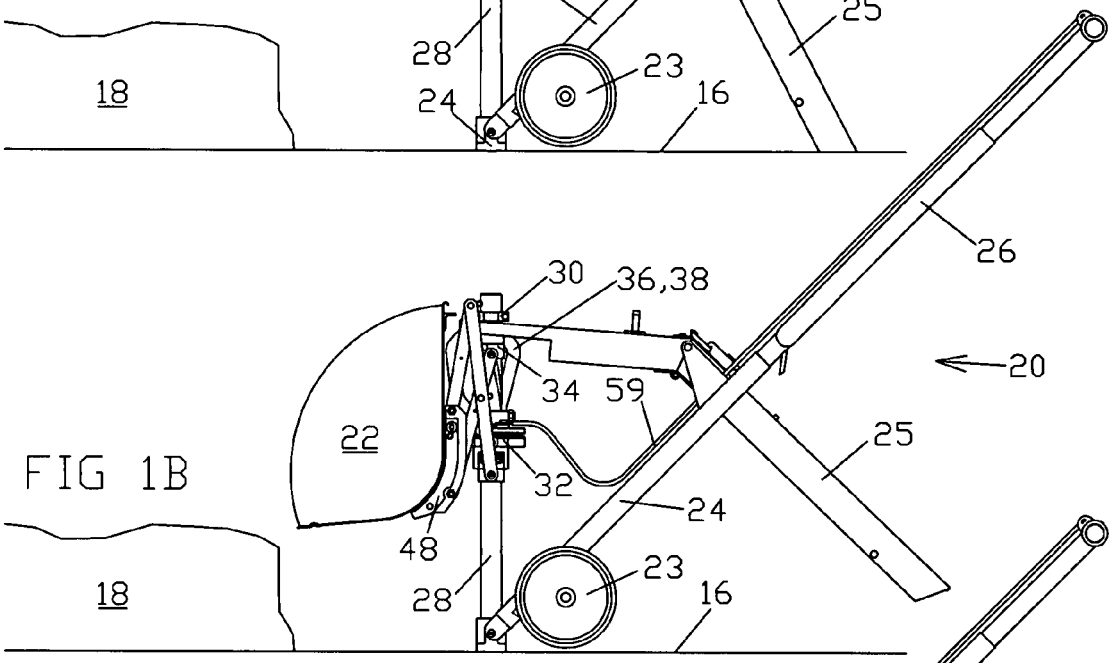
Figure 1A:
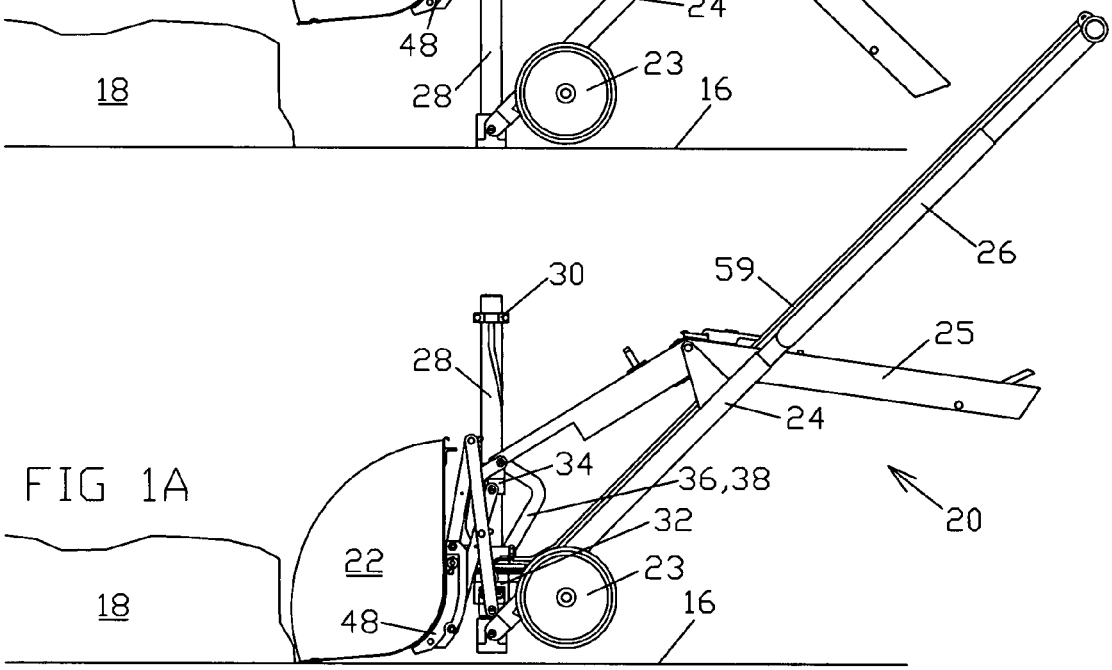

Turning now to the drawings and more particularly to FIG. 1 we have an elevational view of the snow shovel apparatus 20. FIG. 1A shows the shovel portion 22 on the ground 16. FIG. 1B shows the shovel portion 22 vertically lifted as the foot lever 25 is initially depressed. FIG. 1C shows the shovel portion 22 extended and dumping when the foot lever 25 is fully depressed. Most generally a snow shovel apparatus 20 comprises: a) a wheeled 23 frame 24 having; i) an upwardly and rearwardly extending handle 26; ii) an upright post 28 extending from a front portion of the frame 24, said post having a lower end portion carried by the frame 24, an upper end portion having a slide stop 30, and a central portion having a lower slide 32, and an upper slide 34; and, iii) a lever 25 having a central portion hinged to the frame 24, a rearwardly extending end portion, and a forwardly extending slide lift end portion, attached and configured through a slide lift connection means 36 to lift the lower slide 32 when the rearwardly extending end portion thereof is depressed; b) a shovel portion 22 having a bottom snow carrying portion and an upright back portion; c) a lower shovel arm 40 having one end portion hinged to a lower portion of the upright back portion of the shovel portion 22, and having the other opposite end portion hingeably connected to the upper slide 34; d) an upper shovel projecting/dumping linkage 46, having an upper shovel arm 42 having one end hinged to an upper portion of the upright back portion of the shovel portion 22 and having the other end hingeably connected to an upper end portion of a pivoting arm 44, said pivoting arm 44 having the other end portion hingeably connected to the lower slide 32 and a central portion pivotably pinned to a central portion of the lower shovel arm 40. When the slides 32,34 are lifted by the lift end portion of the lever 25 the shovel portion 22 is first lifted up the post 28, and then when the top slide 34 is prevented by the top stop 30 from further upward sliding therealong, the bottom slide 32 continues to move upwardly therealong, causing the other ends of the lower arm 40 and the pivoting arm 44 to move together while generally maintained in vertical alignment, thereby causing the shovel portion 22 to extend outwardly and turn from a snow collection to a dumping position.

In the most general embodiment described above the snow shovel apparatus 20 is intended to include an apparatus 20 used on an ATV or truck having a non-human power source which is used to motivate the lower slide 32. In a preferred embodiment of the invention wherein the lever 25 comprises a foot lever which is configured to have a mechanical advantage so that a substantially greater weight of snow than the force applied to the foot lever can be lifted. If for example the leverage was 2:1 then 50 pounds of snow could be lifted with 25 pounds of foot force. Most preferably the slide lift connection means 36 to lift the lower slide 32 comprises a slide lift arm 38 having a lower end portion hinged to the lower slide 32 and an upper end portion hinged to the lift end portion of the foot lever 25. Most preferably the slide lift arm 38 comprises two arms 38 each having a lower end portion hinged to an opposite side of the lower slide 32 so that the lower slide 32 is lifted without twisting and binding on the upright post 28.

Figure 2:
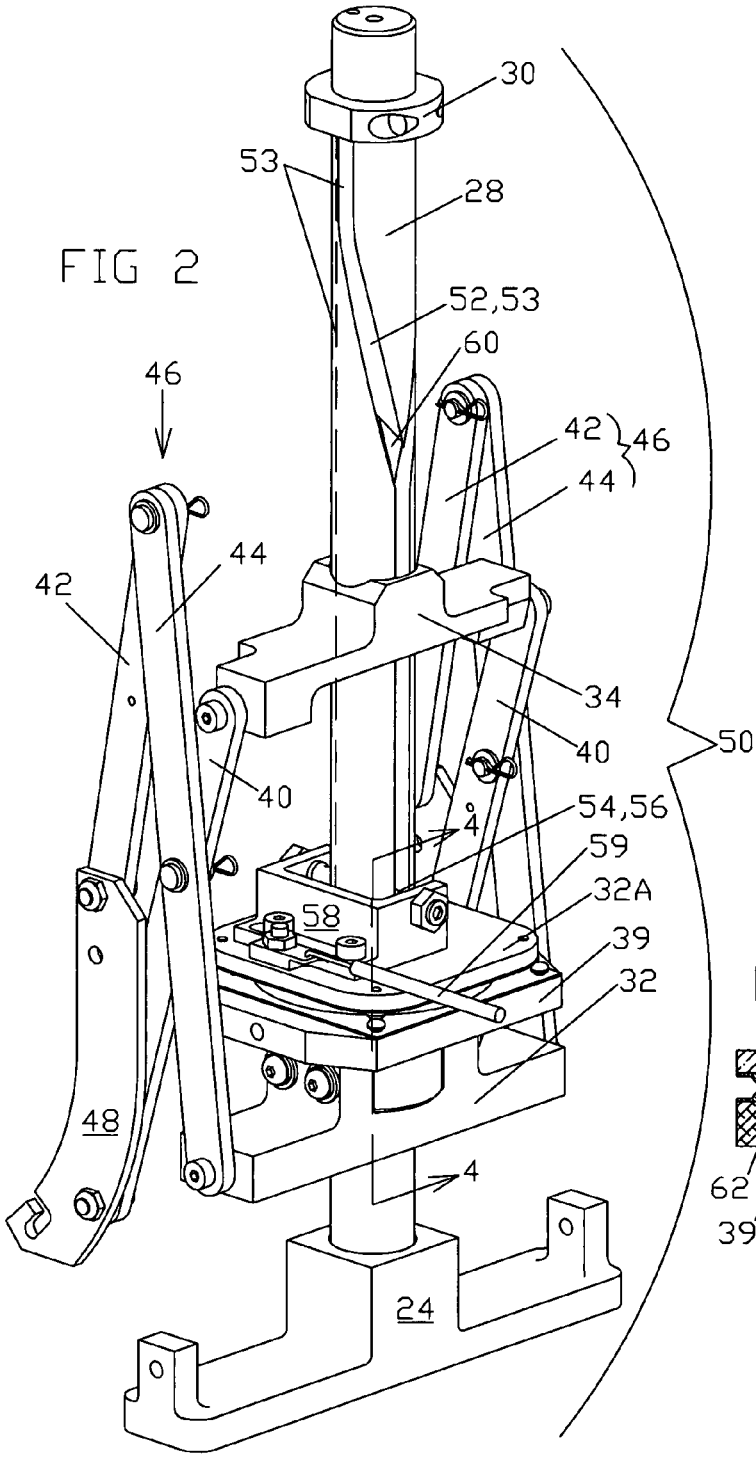
FIG. 2 is an enlarged perspective view of the upright post, the portion of the frame carrying the post, the upper and lower slides on the central portion of the post, the top stop on a top portion of the post, the lower shovel arm and the upper shovel linkage, hinged to the upper and lower slides respectively.

FIG. 2 is an enlarged perspective view of the upright post 28, the portion of the frame 24 carrying the post 28, the upper slide 34 and the lower slide 32 on the central portion of the post, the top stop 30 on a top portion of the post 28, the lower shovel arm 40 and the upper shovel linkage, hinged to the upper 34 and lower 32 slides respectively.

Most preferably each lateral side of the shovel portion 22 is lifted by a lower arm 40 and upper linkage 46. Each lower arm 40 and upper linkage 46 are also hinged to opposite lateral sides of the slides 32,34 thereby better maintaining the shovel portion in a horizontal position and preventing a twisting moment of the slides 32,34 on the post 28. Most preferably a mounting bracket 48 is interposed between the shovel portion 22 and the shovel arms 40,42 to distribute the lifting force more evenly across the shovel portion 22. This mounting bracket 48 can be used to disassemble the shovel portion 22 for shipping. Most preferably the apparatus 20 is configured so that normally, for both lifting and forward movement the shovel portion 22 rests on the ground, and in order to roll the frame 24 the handle 26 must be lowered thereby throwing weight onto the wheel 23.

Figure 3:
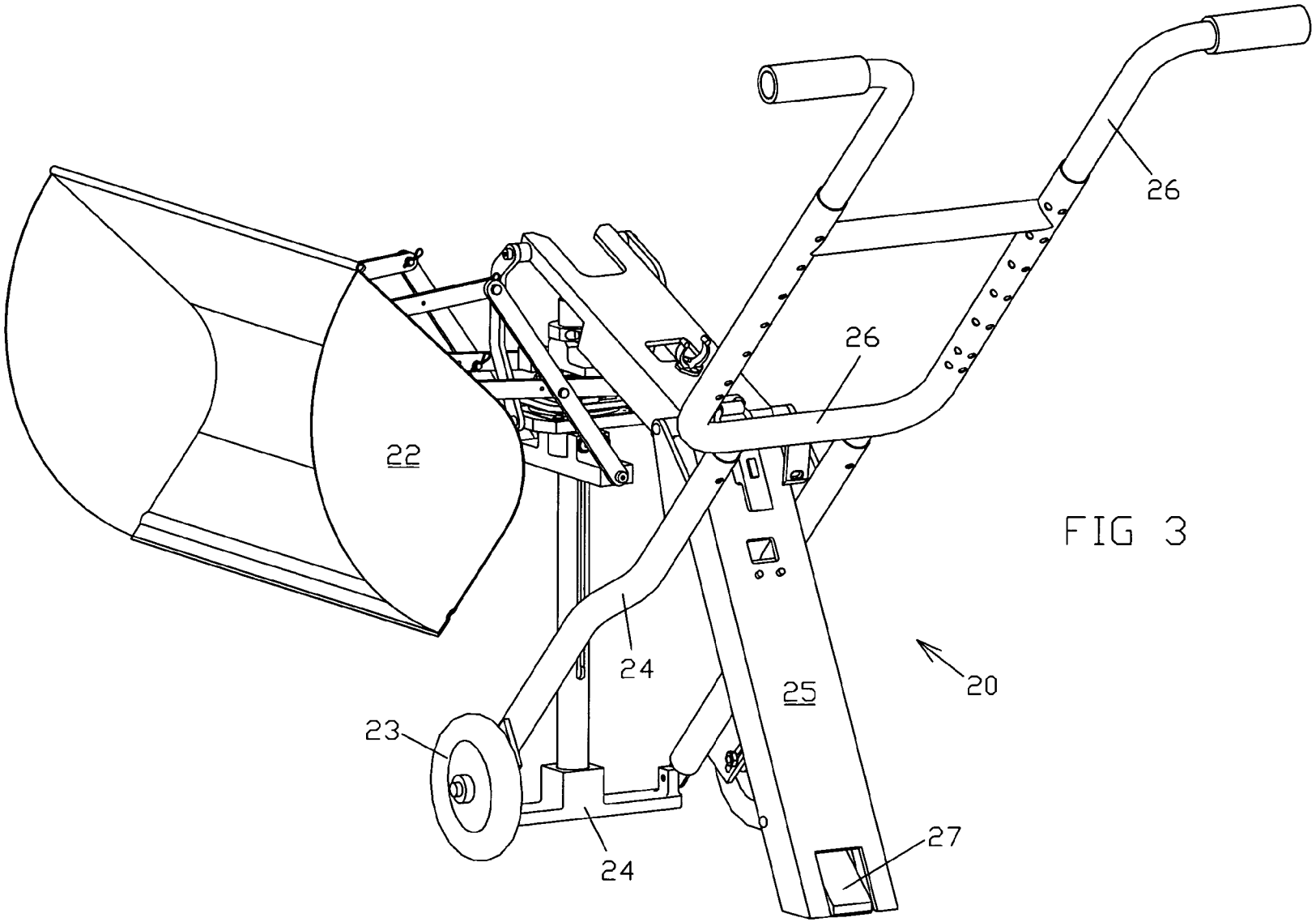
FIG. 3 is a perspective view of the snow shovel apparatus having the shovel portion in an elevated turned position.

FIG. 3 is a perspective view of the snow shovel 20 apparatus having the shovel portion 22 in an elevated turned position. FIG. 3 best shows how the handle 26 is detachable from the frame 24. The foot lever 25 is centrally hinged and detachable from the frame 24 so that the space occupied by the apparatus 20 can be minimized for storage and shipping. Refer back to FIG. 2. In a preferred embodiment of the invention the apparatus 20 further comprises a shovel turn mechanism 50 so that only after the shovel portion 22 is vertically lifted out of snow 18, it turns to a side before dumping thereby providing a cleared area in front of the apparatus 20 so that the apparatus 20 can forwardly proceed clearing snow 18 unimpeded by dumped snow 18. Most preferably said turn mechanism 50 comprises the upright post 28 configured as a cam 52 and having one of the slides 34,32 configured as a cam follower 54. Most preferably the upright post 28 has a generally longitudinal groove 53 therealong and wherein the lower slide 32 has a peg 56 extending into the groove 53 so that the lower slide 32 carrying the shovel arm 40, the shovel portion 22, the shovel linkage 46 and the upper slide 34, will all rotate when the peg 56 follows the groove 53 partially around the post 28. Most preferably the slide lift connection means 36 to lift the lower slide 32 comprises two slide lift arms 38 each having a lower end portion hinged to an opposite lateral side of a lift ring 39 positioned around and under the lower slide 32 and wherein the slide lift arms 38 are positioned inside the shovel arm 40 and the shovel linkage 46, so that it is necessary that the lift arm 38 on the lateral side to which the shovel portion 22 is turning arch forwardly to clear the upper slide 34, and the lift arm 38 on the opposite lateral side to which the shovel portion 22 is turning away from arch rearwardly behind the lower shovel arm 40 to allow the turning arm 40 and shovel portion to swing thereby.

In the most preferred embodiment of the invention there are two longitudinal grooves 53, each on an opposite side of the post 28, and wherein an upper portion of the lower slide 32 comprises a table 32A which carries a laterally sliding U-shaped groove selector 58 having opposite pegs 56 each inwardly directed towards one of the longitudinal grooves 53 in the post 28, so that by laterally sliding the U-shaped groove selector 58 on the table 32A one of the two pegs 53 can be positioned within a selected one of the opposite grooves 53, thereby selecting that longitudinal groove 53 to guide and turn the lower slide 32. Most preferably one of the opposite grooves 53 is straight so that the shovel portion 22 projects and dumps forwardly; and the other groove 53 has an upper portion which is curved around the post 28 so that the shovel portion 22 lifts up out of the snow 18, before turning, projecting and dumping on that side.

In the most preferred embodiment of the invention the curved groove 53 has a Y shaped upper portion so that with use of a groove plug 60, one side of the Y may be blocked thereby causing the peg 56, carried by the lower slide 32 follows the unblocked portion of the Y, so that by both arranging the peg 60 in a bottom portion of one of the sides of the Y, and by appropriately interchanging the forwardly and rearwardly arched lift arms 38 the shovel portion will thereby turn and dump to a selected side of the apparatus 20.

Figure 4:
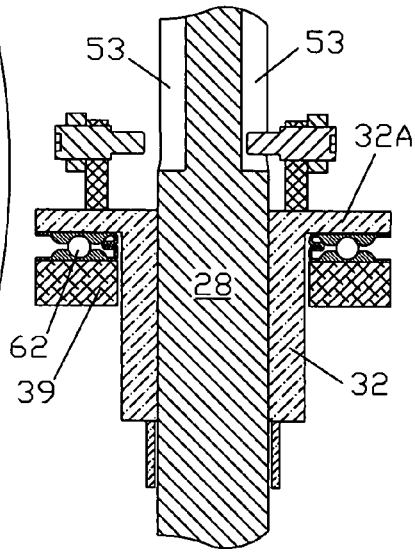
FIG. 4 is a cross sectional view along line 4-4 as shown through the lower guide in FIG. 2.

FIG. 4 is a cross sectional view taken along line 4-4 shown through the lower guide 32 in FIG. 2. FIG. 4 also better shows how the lower slide 32, has a central portion extending beneath table portion 32A which is surrounded by lift ring 39 having lift arms 38 hinged thereto on opposite sides thereof. The inclusion of a bearing 62 between the lift ring 39 and the lower slide 32 facilitates easy turning of the loaded shovel portion 22 relative to the lift arms 38 and frame 24. In a preferred embodiment of the invention the foot end portion of the foot lever 25 further comprises a lock release peddle 27 which unlocks the shovel portion 22 from the lower snow collection position. Without a lock/release peddle 27 said shovel portion inadvertently lifts while collecting snow 18.

While the invention has been described with preferred specific embodiments thereof, it will be understood that this description is intended to illustrate and not to limit the scope of the invention, which is defined by the following claims.

I claim:

1. A snow shovel apparatus comprising:

a) a frame having;

i) an upwardly and rearwardly extending handle;

ii) an upright post extending from a front portion of the frame, said post having a lower end portion carried by the frame, an upper end portion having a slide stop, and a central portion having a lower slide, and an upper slide; and, iii) a lever having a central portion hinged to the frame, a rearwardly extending end portion, and a forwardly extending slide lift end portion, attached and configured through a slide lift connection means to lift the lower slide when the rearwardly extending end portion thereof is depressed;

b) a shovel portion having a bottom snow carrying portion and an upright back portion;

c) a lower shovel arm having one end portion hinged to a lower portion of the upright back portion of the shovel portion, and having the other opposite end portion hingably connected to the upper slide;

d) an upper shovel portion projecting/dumping linkage, having an upper shovel arm having one end hinged to an upper portion of the upright back portion of the shovel portion and having the other end hingably connected to an upper end portion of a pivoting arm, said pivoting arm having the other end portion hingably connected to the lower slide and a central portion pivotably pinned to a central portion of the lower shovel arm;

so that when the slides are lifted, the shovel portion is first lifted up the post by the lift end portion of the lever, and then when the upper slide is prevented by the slide stop from further upward sliding therealong, the lower slide continues to move upwardly therealong, causing the other ends of the lower arm and the pivoting arm to move together while generally maintained in vertical alignment, thereby causing the shovel portion to extend outwardly and turn from a snow collection to a dumping position.

2. An apparatus as in claim 1 wherein the frame further comprises a wheel and wherein the lever comprises a foot lever which is configured to have a mechanical advantage so that a substantially greater weight of snow than the force applied to the foot lever can be lifted.

3. An apparatus as in claim 2 wherein the slide lift connection means to lift the lower slide comprises a slide lift arm having a lower end portion hinged to the lower slide and an upper end portion hinged to the lift end portion of the foot lever.

4. An apparatus as in claim 3 wherein the slide lift arm comprises two arms each having a lower end portion hinged to an opposite side of the lower slide so that the lower slide is lifted without twisting and binding on the upright post.

5. An apparatus as in claim 2 further wherein each lateral side of the shovel portion is lifted by a lower arm and upper linkage, and wherein each lower arm and upper linkage are hinged to opposite lateral sides of the slides thereby better maintaining the shovel portion in a horizontal position and preventing a twisting moment of the slides on the post.

6. An apparatus as in claim 5 further comprising a mounting bracket interposed between the shovel portion and the shovel arms to distribute the lifting force more evenly across the shovel portion.

7. An apparatus as in claim 5 wherein the apparatus is configured so that normally, for bath lifting and forward movement the shovel portion rests on the ground, and in order to roll the frame the handle must me lowered thereby throwing weight onto the wheel.

8. An apparatus as in claim 5 further comprising a shovel turn mechanism so that only after the shovel portion is vertically lifted out of snow, it turns to a side before dumping thereby providing a cleared area in front of the apparatus so that the apparatus can forwardly proceed clearing snow unimpeded by dumped snow; said turn mechanism comprising the upright post configured as a cam and having one of the slides configured as a cam follower.

9. An apparatus as in claim 8 wherein the upright post has a generally longitudinal groove therealong and wherein the lower slide has a peg extending into the groove so that the lower slide carrying the shovel arm, the shovel portion, the shovel linkage, and the upper slide, will all rotate when the peg follows the groove partially around the post.

10. An apparatus as in claim 9 wherein the slide lift connection means to lift the lower slide comprises two slide lift arms each having a lower end portion hinged to an opposite lateral side of a lift ring positioned around and under the lower slide and wherein the slide lift arms are positioned inside the shovel arm and the shovel portion linkage, so that it is necessary that the lift arm on the lateral side to which the shovel portion is turning arch forwardly to clear the upper slide, and the lift arm on the opposite lateral side to which the shovel portion is turning away from, arch rearwardly behind the lower shovel arm to allow the turning arm and shovel portion to swing thereby.

11. An apparatus as in claim 10 wherein there are two longitudinal grooves, each on an opposite side of the post, and wherein an upper portion of the lower slide comprises a table which carries a laterally sliding U-shaped groove selector having opposite pegs each inwardly directed towards one of the longitudinal grooves in the post, so that by laterally sliding the U-shaped groove selector on the table one of the two pegs can be positioned within a selected one of the opposite grooves, thereby selecting that longitudinal groove to guide and turn the sliding lower guide.

12. An apparatus as in claim 11 wherein one of the opposite grooves is straight to facilitate the shovel portion projecting and dumping forwardly; and the other groove has an upper portion which is curved around the post so that after the shovel lifts up, out of the snow, the shovel portion turns and projects to a side before dumping on that side.

13. An apparatus as in claim 12 wherein the curved groove has a Y shaped upper portion so that with use of a groove plug, one side of the Y may be blocked thereby causing the peg, carried by the lower slide to follow the unblocked portion of the Y, so that by both arranging the peg in a bottom portion of one of the sides of the Y, and by appropriately interchanging the forwardly and rearwardly arched lift arms the shovel will thereby turn and dump to a selected side of the apparatus.

14. An apparatus as in claim 13 wherein the lower slide further comprises a bearing between the lift ring and the lower slide to facilitate easy turning of the loaded shovel portion relative to the lift arms and frame.

15. An apparatus as in claim 2 wherein the handle is detachable from the frame and wherein the foot lever is centrally hinged and detachable from the frame so that the space occupied by the apparatus can be minimized for storage and shipping.

16. An apparatus as in claim 2 wherein the foot end portion of the foot lever further comprises a lock release peddle which unlocks the shovel portion from the lower snow collection position, said lock/release peddle provided to prevent said shovel from inadvertently lifting while collecting snow.

17. A snow shovel apparatus comprising:

a) a frame having;

i) an upright post extending from a front portion of the frame, said post having a lower end portion carried by the frame, an upper end portion having a slide stop, and a central portion having a lower slide, and an upper slide; and, ii) a lower slide lift means to lift the lower slide and thereby raise the shovel;

b) a shovel portion having a bottom snow carrying portion and an upright back portion;

c) a lower shovel arm having one end portion hinged to a lower portion of the upright back portion of the shovel portion, and having the other opposite end portion hingably connected to the upper slide;

d) an upper shovel portion projecting/dumping linkage, having an upper shovel arm having one end hinged to an upper portion of the upright back portion of the shovel portion and having the other end hingably connected to an upper end portion of a pivoting arm, said pivoting arm having the other end portion hingably connected to the lower slide and a central portion pivotably pinned to a central portion of the lower shovel arm;

so that when the slides are lifted, the shovel portion is first lifted up the post, and then when the upper slide is prevented by the slide stop from further upward sliding therealong, the lower slide continues to move upwardly therealong, causing the other ends of the lower arm and the pivoting arm to move together while generally maintained in vertical alignment, thereby causing the shovel portion to extend outwardly and turn from a snow collection to a dumping position.

* * * * *